US009941616B2

(12) United States Patent
Szyszko et al.

(10) Patent No.: US 9,941,616 B2
(45) Date of Patent: Apr. 10, 2018

(54) MULTI-PIECE JACKET FOR SEPARABLE CONNECTORS

(71) Applicant: Thomas & Betts International, LLC, Wilmington, DE (US)

(72) Inventors: Stanley S. Szyszko, Wall, NJ (US); Carlos H. Hernandez, Germantown, TN (US); John Knight, Placitas, NM (US)

(73) Assignee: Thomas & Betts International LLC, Wilmington, DE (US)

( * ) Notice: Subject to any disclaimer, the term of this patent is extended or adjusted under 35 U.S.C. 154(b) by 0 days.

(21) Appl. No.: 15/000,236

(22) Filed: Jan. 19, 2016

(65) Prior Publication Data

US 2016/0248187 A1 Aug. 25, 2016

Related U.S. Application Data

(60) Provisional application No. 62/120,061, filed on Feb. 24, 2015.

(51) Int. Cl.
*H01R 4/58* (2006.01)
*H01R 13/424* (2006.01)
(Continued)

(52) U.S. Cl.
CPC ..... *H01R 13/424* (2013.01); *H01B 17/32* (2013.01); *H01R 13/506* (2013.01); *H01R 13/53* (2013.01); *H01R 24/20* (2013.01); *H01R 2101/00* (2013.01)

(58) Field of Classification Search
CPC ..... H01R 13/6485; H01R 9/2491; H01R 13/4223; Y10S 439/921
(Continued)

(56) References Cited

U.S. PATENT DOCUMENTS 2,952,823 A 9/1960 Robinson
3,020,332 A 2/1962 Appleton
(Continued)

FOREIGN PATENT DOCUMENTS

EP 0225190 A2 6/1987
WO 2011061074 A1 5/2011

OTHER PUBLICATIONS

European Search Report, EP16155299, Thomas & Betts International LLC, dated Jun. 21, 2016, 4 pages.

*Primary Examiner* — Abdullah Riyami
*Assistant Examiner* — Thang Nguyen
(74) *Attorney, Agent, or Firm* — Taft Stettinius & Hollister LLP

(57) ABSTRACT

A jacket assembly for a separable connector includes multiple pieces joined by an overlapping or interference fit. The multiple pieces include a body segment between a cable entrance segment and a bushing interface segment. The cable entrance segment includes a bore that extends axially through the cable entrance segment and is sized to receive an insulated power cable. The bushing interface segment includes a lug portion with another bore that is sized to receive a portion of an insulative inner housing and a portion of a conductive insert for accepting a compression lug. The bushing may also be configured to receive another portion of the insulative inner housing and another portion of a conductive insert for accepting a probe or bushing insert from another device. The body segment includes still another bore extending axially from a first end of the body segment to a second end of the body segment.

20 Claims, 7 Drawing Sheets

(51) Int. Cl.

| | |
|---|---|
| ***H01R 13/506*** | (2006.01) |
| ***H01R 13/53*** | (2006.01) |
| ***H01R 24/20*** | (2011.01) |
| ***H01B 17/32*** | (2006.01) |
| *H01R 101/00* | (2006.01) |

(58) Field of Classification Search
USPC ..... 439/88, 181, 625, 921, 638
See application file for complete search history.

(56) References Cited

U.S. PATENT DOCUMENTS

| | | | | |
|---|---|---|---|---|
| 3,323,097 | A | 5/1967 | Tordoff | |
| 3,784,233 | A | 1/1974 | Hilbert | |
| 3,980,374 | A * | 9/1976 | Fallot | H01R 13/53 174/72 R |
| 3,980,805 | A | 9/1976 | Lipari | |
| 4,173,386 | A | 11/1979 | Kauffman et al. | |
| 4,655,534 | A | 4/1987 | Stursa | |
| 4,687,446 | A | 8/1987 | Birch et al. | |
| 4,696,649 | A | 9/1987 | Smorzaniuk et al. | |
| 5,061,206 | A | 10/1991 | Kawanami et al. | |
| 5,508,475 | A | 4/1996 | Profiri et al. | |
| 5,616,887 | A | 4/1997 | Kirma | |
| 5,641,306 | A | 6/1997 | Stepniak | |
| 5,651,699 | A | 7/1997 | Holliday | |
| 5,782,920 | A * | 7/1998 | Colleran | A61F 2/389 403/306 |
| 6,126,482 | A | 10/2000 | Stabile | |
| 6,642,455 | B2 | 11/2003 | Moller et al. | |
| 6,648,684 | B2 | 11/2003 | Tang | |
| 7,419,403 | B1 | 9/2008 | Paynter | |
| 7,878,849 | B2 * | 2/2011 | Hughes | H01R 11/26 439/578 |
| 7,909,635 | B2 | 3/2011 | Hughes et al. | |
| 7,959,639 | B1 * | 6/2011 | McGovern | A61F 2/4684 606/102 |
| 8,047,872 | B2 | 11/2011 | Burris et al. | |
| 8,460,022 | B2 * | 6/2013 | Nguyen | H01R 43/18 439/181 |
| 8,844,318 | B2 | 9/2014 | James et al. | |
| 8,992,250 | B1 * | 3/2015 | Hosler, Sr. | H01R 13/622 439/322 |
| 9,054,471 | B2 * | 6/2015 | Hosler, Sr. | H01R 24/542 |
| 9,444,176 | B2 * | 9/2016 | Siebens | H01R 13/53 |
| 2009/0215299 | A1 * | 8/2009 | Hughes | H01R 13/46 439/278 |
| 2012/0264321 | A1 * | 10/2012 | Siebens | G01R 1/0416 439/296 |

* cited by examiner

MULTI-PIECE JACKET FOR SEPARABLE CONNECTORS

CROSS-REFERENCE TO RELATED APPLICATION

This application claims priority under 35 U.S.C. § 119, based on U.S. Provisional Patent Application No. 62/120,061 filed Feb. 24, 2015, the disclosure of which is hereby incorporated by reference herein.

BACKGROUND OF THE INVENTION

The present invention relates to electrical cable connectors, such as loadbreak or deadbreak connectors for various voltage applications. More particularly, aspects described herein relate to separable connectors that have a conductive insert and a jacket separated by insulation. Loadbreak and deadbreak connectors used, for example, in conjunction with 15 and 25 kV switchgear generally include a power cable elbow connector having one end adapted for receiving a power cable and another end adapted for receiving a loadbreak or deadbreak bushing insert.

DETAILED DESCRIPTION OF THE PREFERRED EMBODIMENTS

The following detailed description refers to the accompanying drawings. The same reference numbers in different drawings may identify the same or similar elements.

According to implementations described herein, a jacket assembly for a separable connector may include multiple pieces joined by an overlapping fit and/or an interference fit. The multiple pieces include a cable entrance segment, a bushing interface segment, and a body segment. The cable entrance segment includes a bore that extends axially through the cable entrance segment and that is sized to receive an insulated power cable. The bushing interface segment includes a lug portion with another bore that is sized to receive a portion of an insulative inner housing and a portion of a conductive insert for accepting a compression lug. The bushing may also be configured to receive another portion of the insulative inner housing and another portion of a conductive insert for accepting a bushing insert from another device. The body segment includes still another bore extending axially from a first end of the body segment to a second end of the body segment.

The body segment is connected to the cable entrance segment and the bushing interface segment in an overlapping manner so that the respective bores of the three segments are axially aligned. While the cable entrance segment and the bushing interface segment may be common parts for a desired application, the body segment may be provided in multiple lengths to join the cable entrance segment and bushing interface segment and form different length jacket assemblies.

Figure 1A:
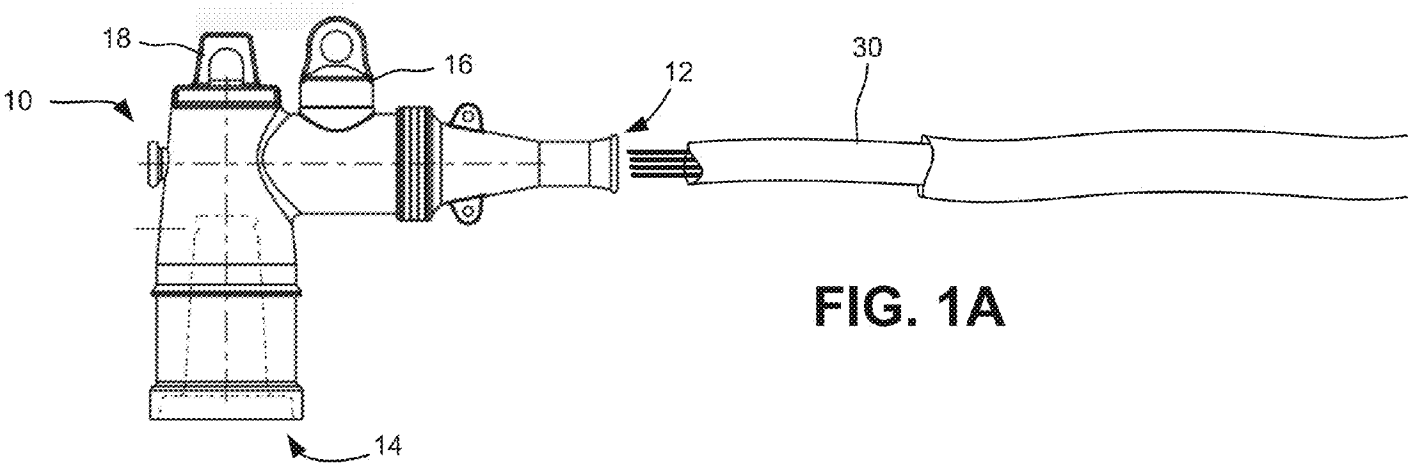
FIGS. 1A and 1B illustrate an environment where devices may be used according to an implementation described herein.
Figure 1B:
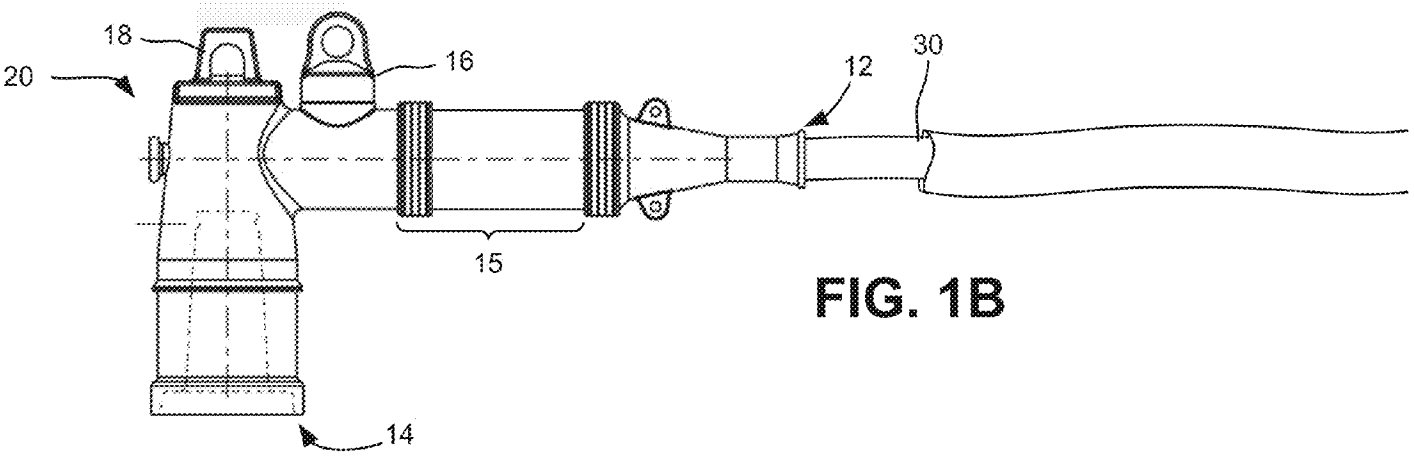

FIGS. 1A and 1B illustrate an environment where devices may be used according to an implementation described herein. Standard separable connectors, such as power cable connector elbow 10 of FIG. 1A, may require replacement due to various failures. Replacement separable connectors, such as power cable connector elbow 20 of FIG. 1B, typically include a longer housing and a longer internal compression lug (e.g., lug 60 shown in FIG. 2) than used in a standard connector. The replacement separable connector accommodates cables 30 that are too short to be connected with a standard elbow. Power cable connector elbow 20 may be used, for example, (1) to repair a failed elbow connection where the cable must be stripped back and a new compression lug applied; (2) to gain extra length when cables have been accidentally trimmed too short or to connect new apparatus to existing cables; or (3) to convert equipment connections from a live front to a dead front without changing the cable. Power cable connector elbow 20 may be sized with dimensions for various power distribution system applications, such as 200 Amp, 600 Amp, 900 Amp or higher applications.

As shown in FIGS. 1A and 1B, each of power cable connector elbows 10/20 may include a conductor receiving end 12 for receiving power cable 30 therein and bushing interface 14 that includes openings for receiving an equipment bushing, such as a deadbreak or loadbreak transformer bushing or another high or medium voltage terminal, such as an insulating plug, or other power equipment. Each of power cable connector elbows 10/20 may also include a test point terminal 16 and an operating eye 18. Test point terminal 16, shown with a removable cover in FIGS. 1A and 1B, may include an electrode for determining if a circuit within power cable connector elbow 10/20 is energized. Operating eye 18 may include a rigid loop to enable engagement with a hotstick or another device used by a technician to maneuver power cable connector elbow 10/20. Thus, according to implementations described herein, the external structure of power cable connector elbow 10 and power cable connector elbow 20 may be identical with the exception of an additional segment 15 shown in FIG. 1B.

Figure 2:
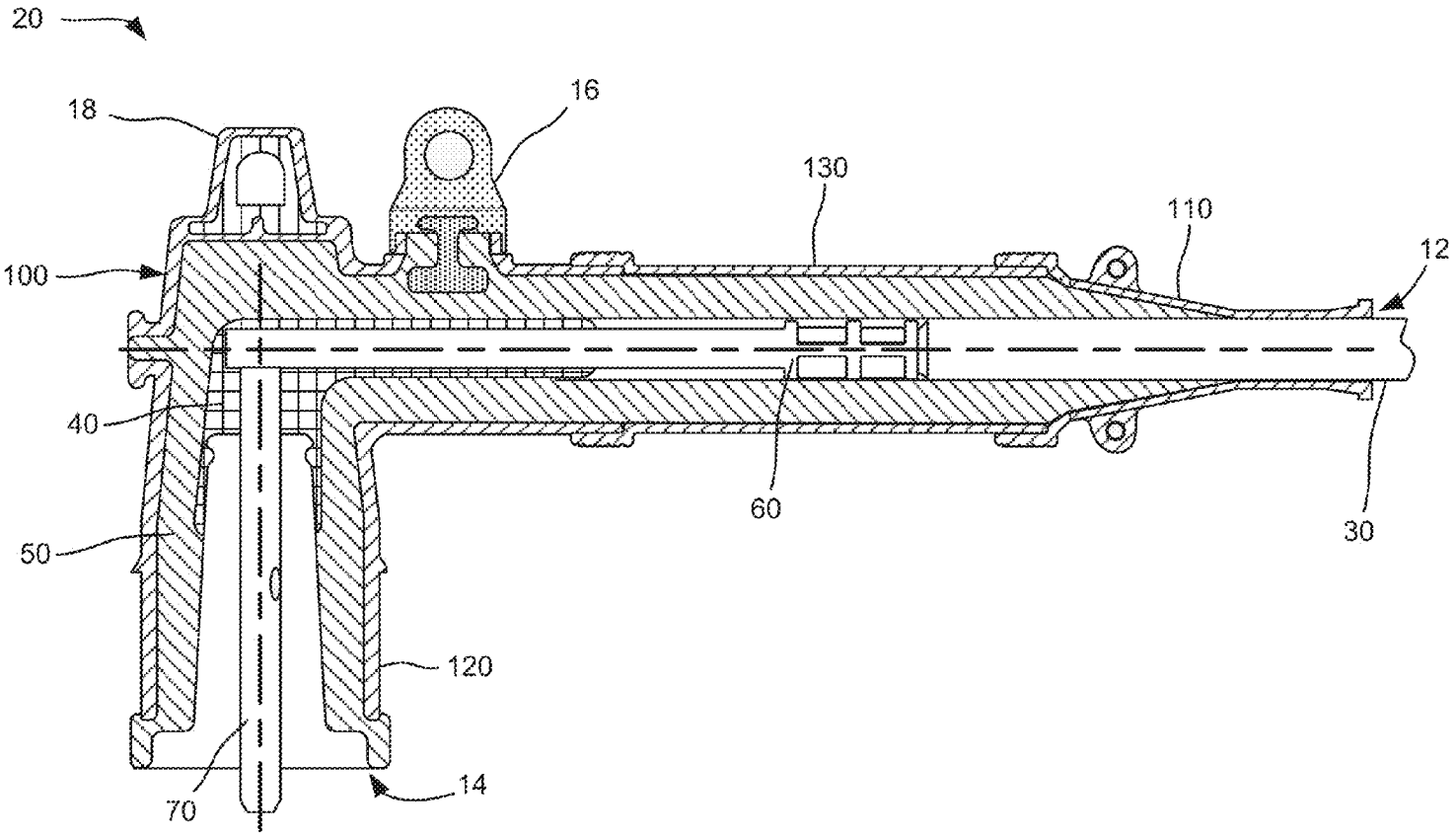
FIG. 2 provides a simplified cross-sectional view of one of the power cable connector elbows of FIG. 1.

FIG. 2 provides a simplified cross-sectional view of power cable connector elbow 20 with additional internal components. Power cable connector elbow 20 generally includes a conductive insert 40 that surrounds a connection portion of power cable connector elbow 20 and an insulative inner housing 50 within a jacket assembly 100 (jacket assembly 100 may also be referred to as a shield). In one method of assembly, jacket assembly 100 may be assembled over the conductive insert 40, and material for the insulative inner housing 50 may be injected between conductive insert 40 and jacket assembly 100 to complete power cable connector elbow 20. Insulative inner housing 50 may include an insulative rubber or epoxy material, and a conductive insert 40 may include a conductive or semi-conductive material, such as a peroxide-cured synthetic rubber, commonly referred to as EPDM (ethylene-propylene-dienemonomer). As shown in FIG. 2, an extended compression lug 60 may be inserted through conductor receiving end 12 into an axial bore formed in conductive insert 40, insulative housing 50 and jacket assembly 100. Compression lug 60 may provide an electrical connection with power cable 30. As further shown in FIG. 2, an electrically conductive probe 70 (also referred to as a stud) may be inserted through bushing interface 14 into another axial bore formed in conductive insert 40, insulative housing 50 and jacket assembly 100. Thus, probe 70 may connect to compression lug 60 within connector elbow 20.

Jacket assembly 100 may be formed from, for example, the same material as conductive insert 40 (e.g., EPDM rubber) or another semi-conductive material. According to implementations described further herein, jacket assembly 100 may be connected from multiple overlapping components to provide a protective deadfront shield that meets industry standards (e.g., Institute of Electrical and Electronics Engineers (IEEE) Standard 592, Rev. 2007) for industrial separable connectors (e.g., passing 10,000 Amps to ground).

Figure 3:
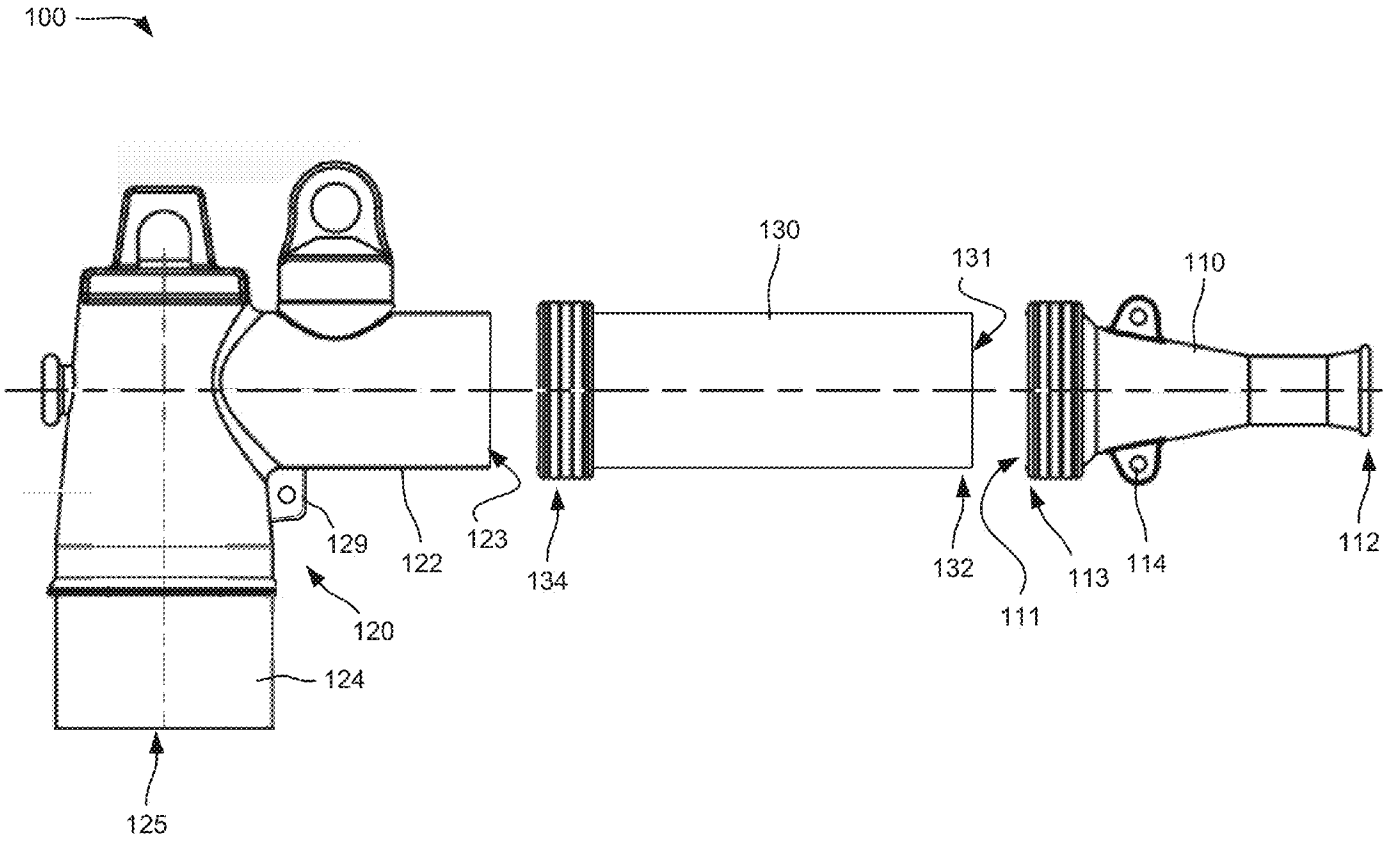
FIG. 3 provides an exploded side view of a jacket assembly of FIG. 2.
Figure 4:
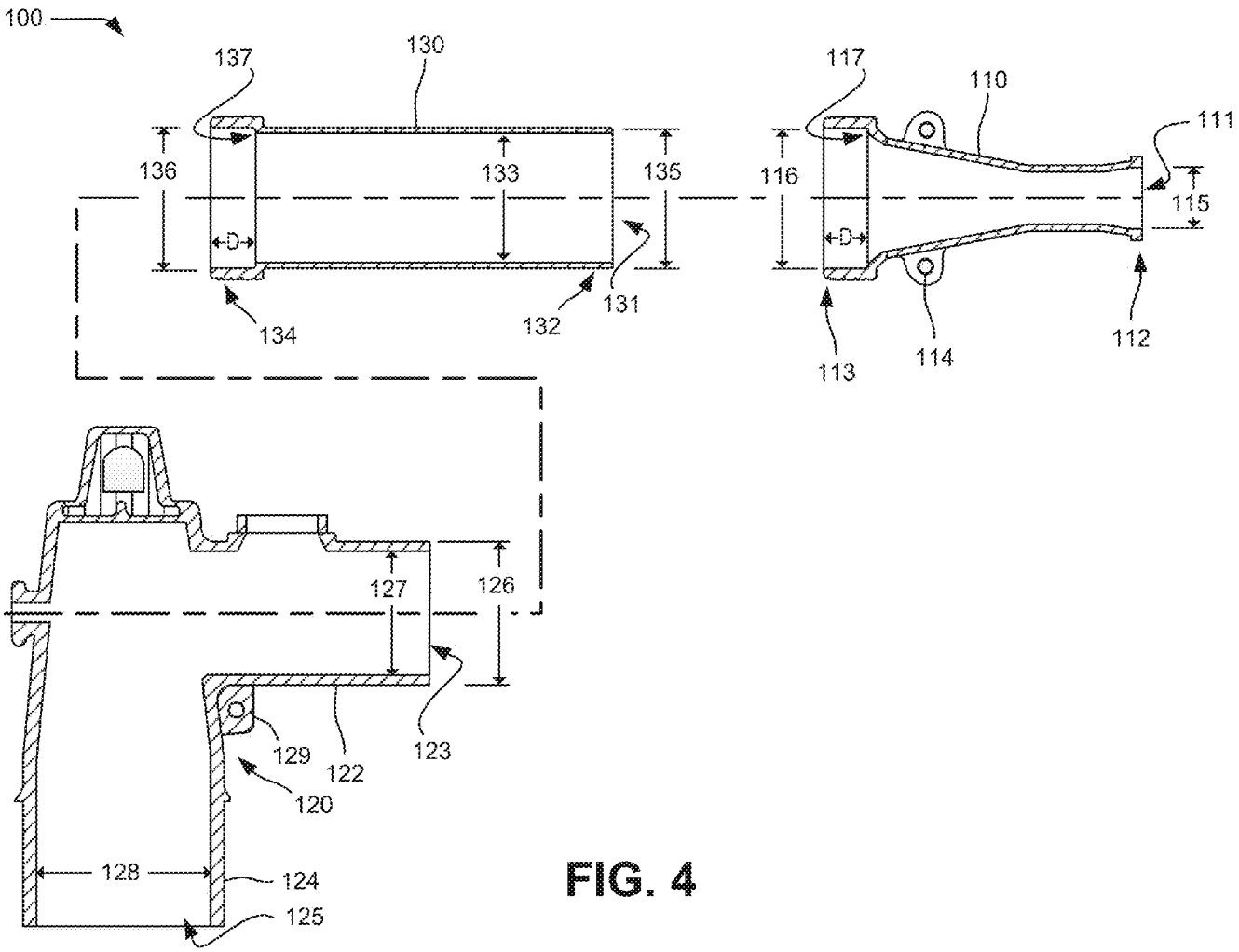
FIG. 4 provides an exploded cross-sectional side view of the jacket assembly of FIG. 2.

FIG. 3 provides an exploded view of a jacket assembly 100, and FIG. 4 provides an exploded cross-sectional view of jacket assembly 100 (with the cover of test point terminal 16 removed). Referring collectively to FIGS. 1-4, according to implementations described herein, jacket 100 may include a common cable entrance segment 110 and a common bushing interface segment 120 (e.g., each common segment 110/120 dimensioned for a particular application, such as 200 Amp loadbreak, 200 Amp deadbreak, 600 Amp deadbreak, etc.) joined in overlapping fashion by one or more body segments 130.

Cable entrance segment 110 may include an axial bore 111 extending from a power cable receiving end 112 to a body extension receiving end 113, and one or more grounding tabs 114. As used herein the term "bore" may refer to the inside diameter of a hole, tube, or hollow cylindrical object or device. In one implementation, axial bore 111 may taper from a larger diameter 116 at body extension receiving end 113 to a smaller diameter 115 at power cable receiving end 112. The smaller diameter 115 at power cable receiving end 112 may be sized to accommodate and support an insulated power cable 30 with the cable jacket removed. The larger diameter 115 of axial bore 111 at body extension receiving end 113 may be sized to receive a corresponding end (e.g., first end 132) of body segment 130 with an overlapping and/or interference fit. Grounding tabs 114 may be molded as an appendage to cable entrance segment 110 and include a hole for attachment of a grounding wire.

Bushing interface segment 120 may provide an elbow bend that includes lug portion 122 with an axial bore 123 joined to an essentially perpendicular probe portion 124 with another axial bore 125. Bushing interface segment 120 may also include a grounding tab 129 (shown in FIGS. 3 and 4). Lug portion 122 may include sheathing/openings for test point terminal 16 and operating eye 18. Axial bore 123 may be sized with an inside diameter 127 to contain a portion of insulative inner housing 50 and conductive insert 40 with an internal bore for compression lug 60. Lug portion 122 may have an outside diameter 126 that is equal to or slightly larger than an inside diameter (e.g., inside diameter 136 described below) of body segment 130. Axial bore 125 may be sized with an inside diameter 128 to contain a portion of insulative inner housing 50 and conductive insert 40 with an internal bore for probe 70 that may be threaded into or inserted through an end of compression lug 60 within bushing interface segment 120. In one implementation, a distal end of probe portion 124 may also be adapted for receiving a loadbreak bushing insert or another switchgear device. The distal end of probe portion 124 that is adapted for receiving the bushing insert generally includes an elbow cuff for providing an overlapping and/or interference fit with a molded flange on the bushing insert. Grounding tab 129 may be molded as an appendage to bushing interface segment 120, for example, near a junction of lug portion 122 and probe portion 124 and may include a hole for attachment of a grounding wire.

Body segment 130 may be used to form the additional segment 15 shown in FIG. 1B. Body segment 130 may include an axial bore 131 extending from a first end 132 to a second end 134. At first end 132, axial bore 131 may have a same or similar diameter 133 as that of first axial bore 123 and may be sized to contain a portion of conductive insert 40 and insulative inner housing 50. First end 132 may have an outside diameter 135 that is the same or slightly larger than that of diameter 116 of axial bore 111 at body extension receiving end 113. Thus, first end 132 may be inserted into axial bore 111 at body extension receiving end 113 to form an overlapping and/or interference fit. At second end 134, axial bore 131 may have an inside diameter 136 that is equal to or slightly smaller than that of outside diameter 126 of lug portion 122. In one implementation, inside diameter 136 is the same as that of diameter 116 of axial bore 111 at body extension receiving end 113. Thus, lug portion 122 may be inserted into axial bore 131 at second end 134 to form an overlapping and/or interference fit. In one implementation, outside diameter 135 may be the same as that of outside diameter 126 of lug portion 122.

As shown in FIG. 4, a shoulder 117 may be formed at a transition point where axial bore 111 begins to taper from diameter 116 toward diameter 115. Shoulder 117 may provide a stopping point for insertion of either body segment 130 (e.g., first end 132) or lug portion 122 into axial bore 111. The distance, D, between shoulder 117 and body extension receiving end 113 provides sufficient overlap between cable entrance segment 110 and lug portion 122 or body segment 130 so as to provide grounding properties similar to if cable entrance segment 110 and lug portion 122 or body segment 130 were a continuously molded piece. In one implementation, a bonding material or lubricant may be applied at the interface of cable entrance segment 110 and lug portion 122 or body segment 130 to ensure proper contact is achieved and maintained.

Similarly, a shoulder 137 may be formed at a transition point between diameter 133 and diameter 136 of axial bore 131. Shoulder 137 may provide a stopping point for insertion of lug portion 122 into axial bore 131. The distance, D, of shoulder 137 to second end 134 may provide sufficient overlap between lug portion 122 and body segment 130 so as to provide grounding properties similar to if lug portion 122 and body segment 130 were a continuously molded piece. In one implementation, distance D may exceed one half inch. In one implementation, a bonding material or lubricant may be applied at the interface of lug portion 122 and body segment 130 to ensure proper contact is achieved and maintained.

Figure 5:
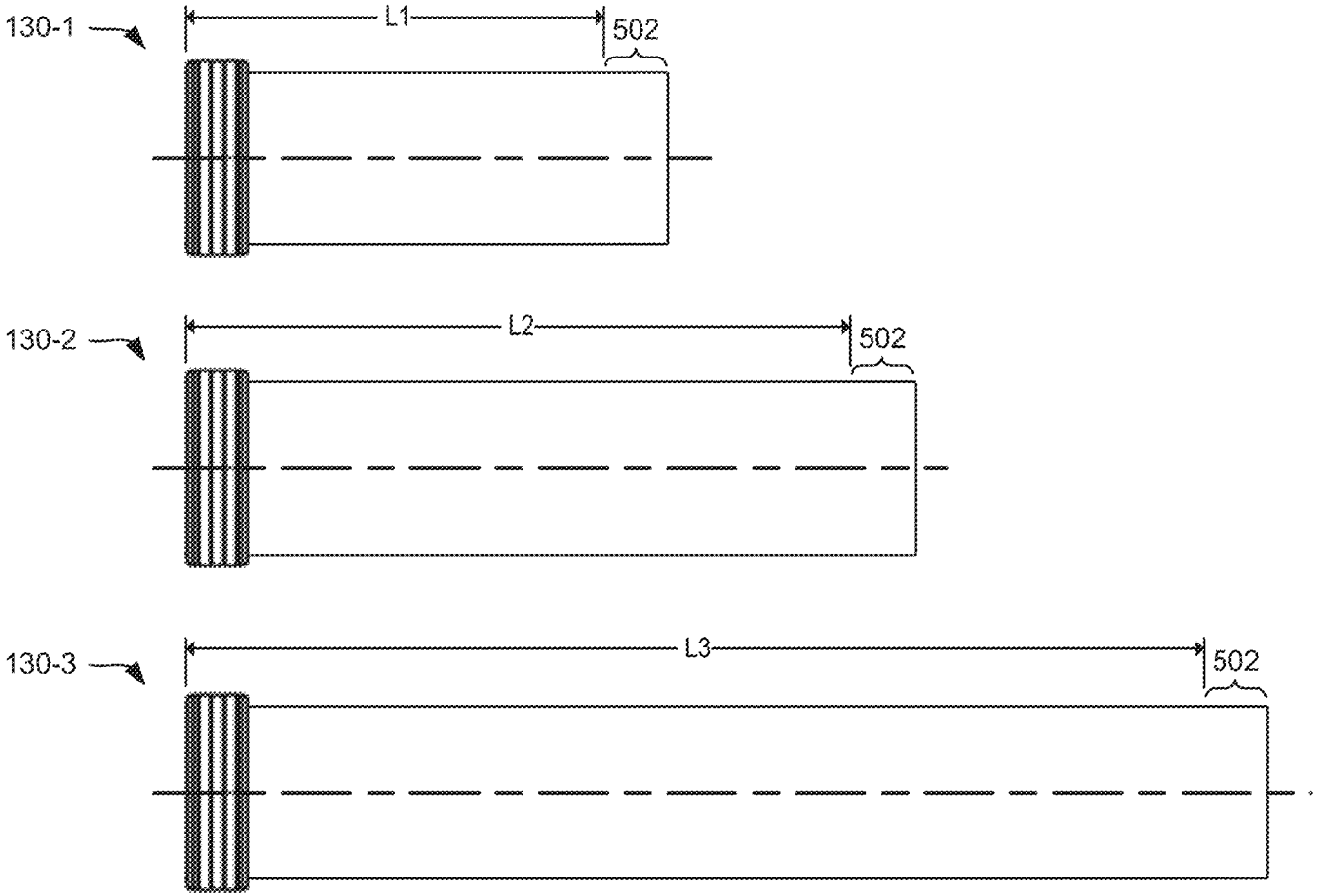
FIG. 5 provides simplified side views of multiple lengths of body segments of FIG. 3.

FIG. 5 provides simplified side views of multiple lengths of body segment 130, indicated as body segments 130-1, 130-2, and 130-3. According to implementations described herein, body segments 130 may be fabricated to different sizes such that the axial length of each body segment 130 may match a desired extension length between cable entrance segment 110 and bushing interface segment 120 for power cable connector elbow 20 (as compared to power cable connector elbow 10 designed for the same voltage rating). The extension length (e.g., L1, L2, L3, etc.) may be the total length of the respective body segment 130-1, 130-2, or 130-3 minus an additional overlap portion 502. Overlap portion 502 may correspond to distance D (FIG. 4) between shoulder 117 and body extension receiving end 113 of cable entrance segment 110. For example, body segment 130-1 may correspond to a two-inch extension L1; body segment 130-2 may correspond to a four-inch extension L2; and body segment 130-3 may correspond to a six-inch extension, L3.

Figure 6:
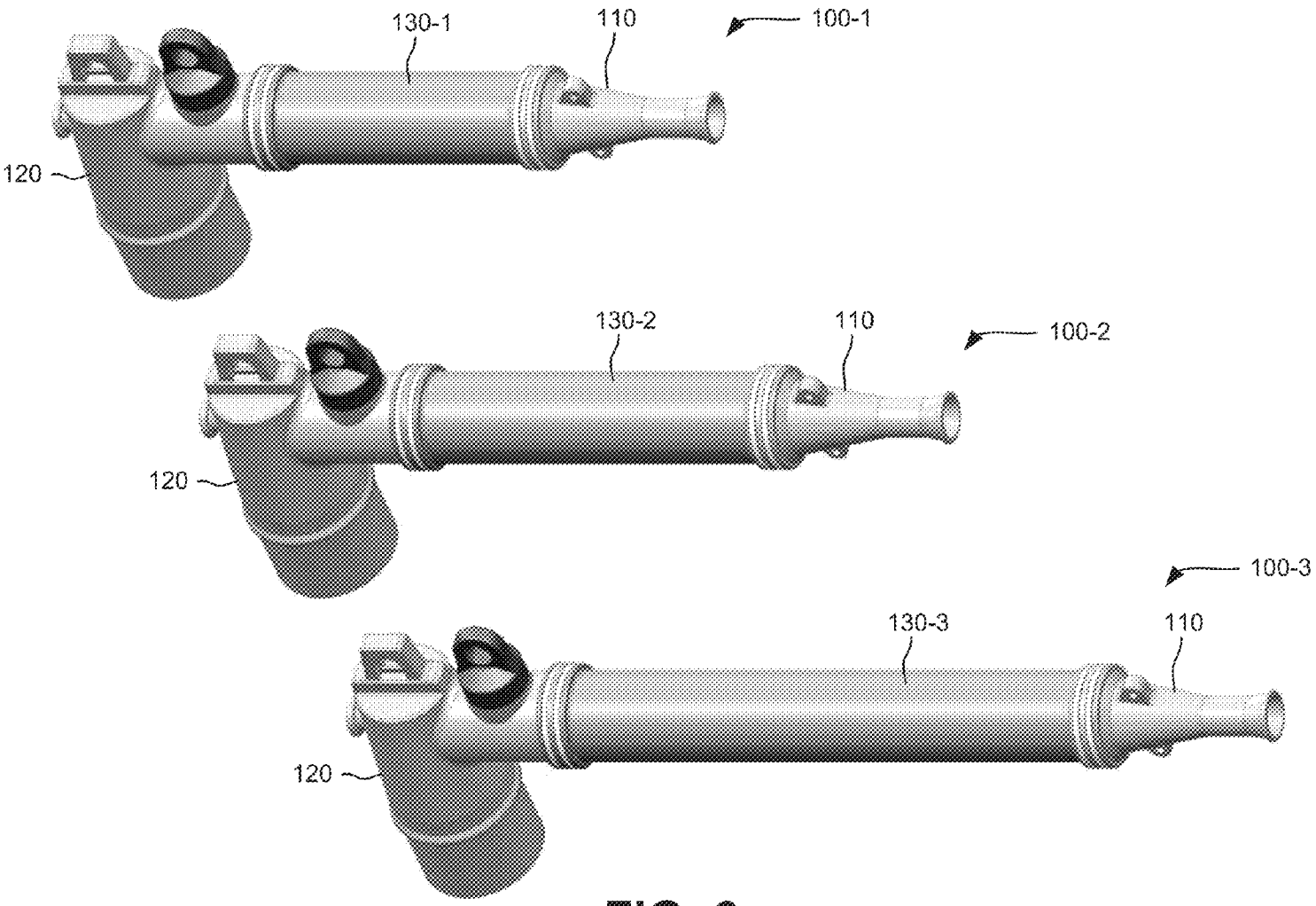
FIG. 6 provides simplified perspective views of multiple sizes of jacket assemblies that can be made using the different lengths of body segments of FIG. 5.

FIG. 6 provides simplified perspective views of multiple sizes of jacket assemblies 100, indicated as jacket assemblies 100-1, 100-2, and 100-3, which can be made using the different body segments 130 of FIG. 5. More particularly, different length body segments 130-1, 130-2, and/or 130-3 may be selected to assemble jacket assemblies 100-1, 100-2, and/or 100-3. Cable entrance segments 110 and bushing interface segments 120 may be standard components sized for a particular voltage application. Body segment 130-1 may be connected (e.g., via an overlapping and/or interference fit as described above) between one cable entrance segment 110 and one bushing interface segment 120 to create jacket assembly 100-1 for a replacement separable connector, such as power cable connector elbow 20 of FIG. 1B. In one implementation, cable entrance segment 110, bushing interface segment 120, and body segment 130-1 may be assembled over an appropriately-sized conductive insert 40 (FIG. 2) so that material for insulation housing 50 may be injected between conductive insert 40 and jacket assembly 100-1 to form power cable connector elbow 20. According to implementations described herein, jacket assemblies 100-1, 100-2, and 100-3 may be provided with different bore diameters to accommodate different sizes of power cables (power cable 30 of FIG. 1) for particular applications. Thus, body segments 130-1, 130-2, and 130-3 may be provided in different diameter sizes, as well as different axial lengths.

Figure 7:
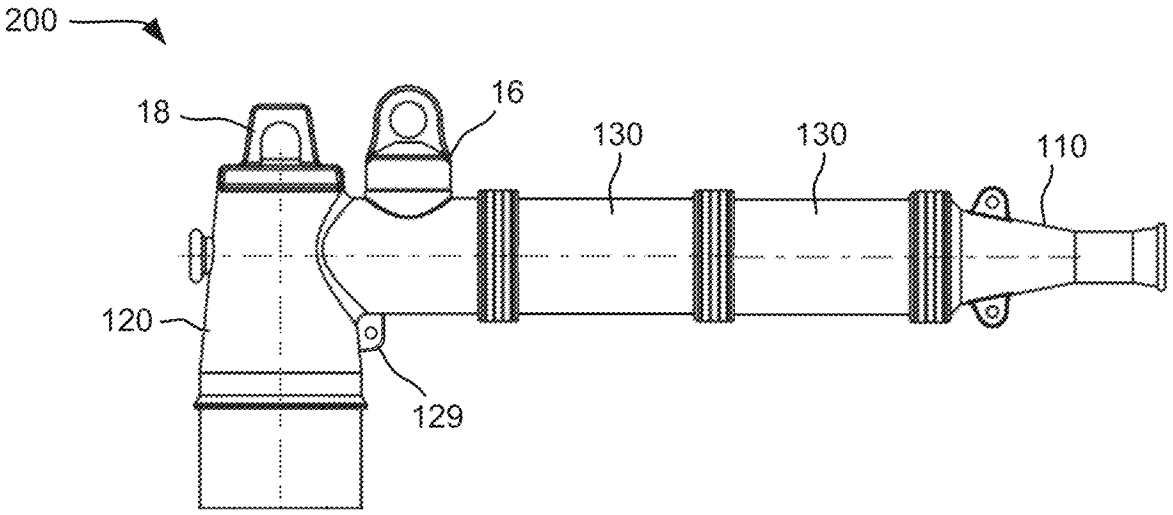
FIG. 7 provides a simplified side view of a jacket assembly that can be made using multiple body segments of FIG. 5.

FIG. 7 provides a simplified side view of a jacket assembly 200, which can be made using multiple body segments 130 of FIG. 5. More particularly, different body segments 130 may be joined in sequence between one cable entrance segment 110 and one bushing interface segment 120 (shown in FIG. 7 with optional grounding tab 129) to create jacket assembly 200 for a replacement separable connector, such as power cable connector elbow 20 of FIG. 1B. The two body segments 130 may be connected to each other with an overlapping and/or interference fit in the same manner that one end of one body segment 130 is joined to cable entrance segment 110 and another end of the other body segment 130 is joined to bushing interface segment 120. Thus, multiple body segments 130 may be joined to form different length jackets for desired separable connector applications. Different diameters sizes for cable entrance segments 110 and bushing interface segments 120 may also be provided.

According to implementations described herein, a multi-piece jacket assembly may replace current one or two piece designs of conductive jackets. The multi-piece jacket assembly allows for a common cable entrance segment and bushing interface segment with multiple lengths of the body segments for use in repair and replacement elbows. The multi-piece jacket assembly allows for molding of more common products, therefore simplifying and reducing the cost of special products (e.g., particular body segments). The three components of the jacket will overlap to create a complete conductive shield over the insulation for safety and protection of a separable connector system. The overlap of conductive components and proper bonding/grounding will enable the conductive jacket assembly to take the conductor in the separable connector to ground if a fault occurs.

The foregoing description of exemplary implementations provides illustration and description, but is not intended to be exhaustive or to limit the embodiments described herein to the precise form disclosed. Modifications and variations are possible in light of the above teachings or may be acquired from practice of the embodiments. For example, implementations described herein may also be used in conjunction with other devices, such as high voltage switchgear equipment, including 15 kV, 25 kV, or 35 kV equipment.

For example, various features have been mainly described above with respect to electrical splicing connectors. In other implementations, other medium/high voltage power components may be configured to include the sacrificial appendage/adapter configurations described above.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above-mentioned description is to be considered exemplary, rather than limiting, and the true scope of the invention is that defined in the following claims.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

What is claimed is:

1. A jacket assembly for a separable connector, comprising:

a cable entrance segment including a first bore extending axially through the cable entrance segment and sized to receive an insulated power cable;

a bushing interlace segment including:

a lug portion with a second bore that is sized to receive a portion of an insulative inner housing and a portion of a conductive insert for accepting a compression lug, and a probe portion with a third bore, oriented perpendicularly to the second bore, and sized to receive another portion of the insulative inner housing and another portion of the conductive insert for accepting a probe; and a body segment including a fourth bore extending axially from a first end of the body segment to a second end of the body segment, wherein the body segment is connected to the cable entrance segment and the bushing interface segment in an overlapping manner so that the first bore, the second bore, and the fourth bore are axially aligned.

2. The jacket assembly of claim 1, wherein the first end of the body segment is received within a part of the first bore via an interference fit.

3. The jacket assembly of claim 2, wherein the lug portion of the bushing interface segment including the second bore is received within a part of the fourth bore via an interference fit.

4. The jacket assembly of claim 3, wherein a first diameter of the fourth bore at the first end is smaller than a second diameter of the fourth bore at the second end, and wherein the body segment further comprises:

a shoulder at a transition point between the first diameter and the second diameter.

5. The jacket assembly of claim 4, wherein the shoulder provides a stopping point for insertion of the lug portion into the fourth bore.

6. The jacket assembly of claim 1, wherein the cable entrance segment, the bushing interface segment, and the body segment comprise an ethylene-propylene-dienemonomer (EPDM) material.

7. The jacket assembly of claim 1, wherein the jacket assembly provides a conductive shield over the insulative inner housing.

8. The jacket assembly of claim 1, further comprising:

another body segment including a fifth bore extending axially from a first end of the other body segment to a second end of the other body segment, wherein the other body segment is connected to the body segment and the cable entrance segment in an overlapping manner so that the first bore, the second bore, the fourth bore, and the fifth bore are axially aligned.

9. The jacket assembly of claim 8, wherein the first end of the other body segment is received within a part of fourth bore, at the second end of the body segment, via an interference fit.

10. The jacket assembly of claim 1, wherein the body segment is selected from one of a group of multiple body segments having different axial lengths.

11. The jacket assembly of claim 1, wherein the separable connector comprises a power cable connector elbow.

12. The jacket assembly of claim 1, wherein the cable entrance segment further comprises one or more grounding tabs on an outer surface of the cable entrance segment or an outer surface of the bushing interface segment, and wherein the bushing interface segment further comprises an operating eye to enable engagement with a hotstick.

13. The jacket assembly of claim 1, wherein an outside diameter of the lug portion of the bushing interface segment is the same as an outside diameter of the first end of the body segment.

14. A separable connector, comprising:

a conductive insert for accepting a compression lug and a probe;

a jacket assembly; and an insulative inner housing disposed between the conductive insert and the jacket assembly, wherein the jacket assembly includes:

a cable entrance segment including a first bore extending axially through the cable entrance segment and sized to receive an insulated power cable;

a bushing interface segment including:

a lug portion with a second bore that is sized to receive a portion of the insulative inner housing and a portion of the conductive insert, and a probe portion with a third bore, oriented perpendicularly to the second bore, and sized to receive another portion of the insulative inner housing and another portion of a conductive insert; and a body segment including a fourth bore extending axially from a first end of the body segment to a second end of the body segment, wherein the body segment is connected to the cable entrance segment and the bushing interface segment in an overlapping manner so that the first bore, the second bore, and the fourth bore are axially aligned.

15. The separable connector of claim 14, wherein the lug portion of the bushing interface segment including the second bore is received within a part of the fourth bore via an interference fit.

16. The separable connector of claim 15, wherein the first end of the body segment is received within a part of the first bore via an interference fit.

17. The separable connector of claim 14, wherein a first diameter of the fourth bore at the first end is larger than a second diameter of the fourth bore at the second end, and wherein the body segment further comprises:

a shoulder at a transition between the first diameter and the second diameter, wherein the shoulder provides a stopping point for insertion of the lug portion into the fourth bore.

18. The separable connector of claim 14, wherein the cable entrance segment, the bushing interface segment, and the body segment comprise an ethylene-propylene-dienemonomer (EPDM) material.

19. The separable connector of claim 14, wherein the separable connector comprises a power cable connector elbow.

20. The separable connector of claim 14, wherein an outside diameter of the lug portion of the bushing interface segment is the same as an outside diameter of the first end of the body segment.

* * * * *